US008651969B1

(12) United States Patent
Dowtin, III

(10) Patent No.: US 8,651,969 B1
(45) Date of Patent: Feb. 18, 2014

(54) NOVELTY MASK DISPLAY

(76) Inventor: James Morgan Dowtin, III, Greensboro, NC (US)

( * ) Notice: Subject to any disclaimer, the term of this patent is extended or adjusted under 35 U.S.C. 154(b) by 151 days.

(21) Appl. No.: 13/400,797

(22) Filed: Feb. 21, 2012

(51) Int. Cl.
*A63H 37/00* (2006.01)
*A63H 33/26* (2006.01)

(52) U.S. Cl.
USPC ..... 472/51; 40/427; 446/391

(58) Field of Classification Search
USPC ..... 472/51, 57, 61, 63, 70, 72, 81, 137; 40/427; 446/391–395
See application file for complete search history.

(56) References Cited

U.S. PATENT DOCUMENTS

| | | | | |
|---|---|---|---|---|
| 2,334,750 | A * | 11/1943 | Cerracchio | 434/365 |
| 5,782,698 | A * | 7/1998 | Keller | 472/61 |
| 6,709,339 | B1 * | 3/2004 | Hargabus | 472/63 |
| 6,929,552 | B1 * | 8/2005 | Hargabus | 472/61 |
| 8,021,238 | B2 * | 9/2011 | White | 472/63 |

* cited by examiner

*Primary Examiner* — Kien Nguyen
(74) *Attorney, Agent, or Firm* — Jeffrey M. Reichard; Nexsen Pruet, LLC

(57) ABSTRACT

Mask display systems, sales and display systems, and related methods are shown and described. In one example, a mask display system comprises a head portion, a pair of hands attached to the head portion, and a suspension system, serving as a novelty simulation of a peeping tom.

20 Claims, 5 Drawing Sheets

NOVELTY MASK DISPLAY

BACKGROUND

The current disclosure is directed to novelty mask displays, sales systems, and related methods.

A variety of novelty displays are known in the art. For example, novelty displays are commonly used around Halloween to produce an emotion upon visualization, e.g., excitement or fear. Applicant believes however that improvements can be made in terms of at least one of: the type of novelty items produced, the enjoyment produced from using novelty items, and the fear or excitement elicited from a novelty item. It is to at least one of these, or additional problems, that the current disclosure is directed.

SUMMARY

By way of summary, the current disclosure is directed to a variety of mask display systems (mask display system) for mounting on an external side of a window. The current disclosure is also directed to methods of displaying mask display system, methods of selling mask display system, systems for selling, and methods of manufacturing mask display system.

In one example, a mask display system comprises a head portion, a pair of hands attached to the head portion, and a suspension system. A user will position the mask display system for visualization by a target person located internally relative to the external surface of the window. The suspension system is attached to a surface, e.g., a pane or frame of the window, and the head portion is positioned such that the face is facing internally. The hands are positioned proximally to the window. When visualized by the target person, the target person believes there is a peeping tom looking through the window at the target, thereby eliciting excitement from the target.

The above summary was intended to summarize one example of the present disclosure. Other examples will be set forth in more detail in the figures and detailed description below. It will be apparent, however, that the detailed description is not intended to limit the present invention.

BRIEF DESCRIPTION OF THE FIGURES

The invention will be better understood by a reading of the Detailed Description of the Examples of the Invention along with a review of the drawings, in which.

Figure 5:
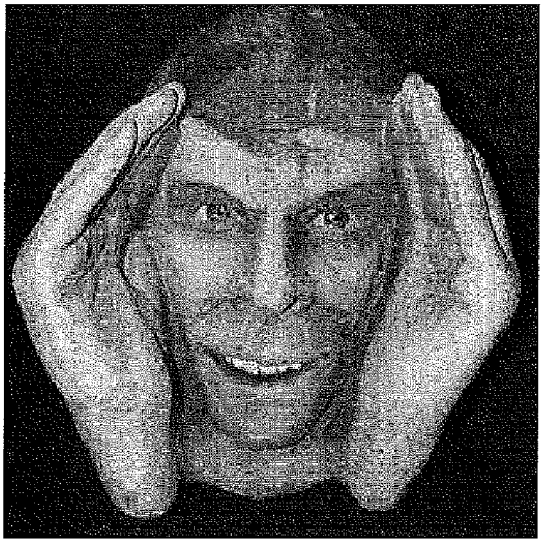
FIG. 5 is a front perspective view of a mask display system showing my new design.
Figure 6:
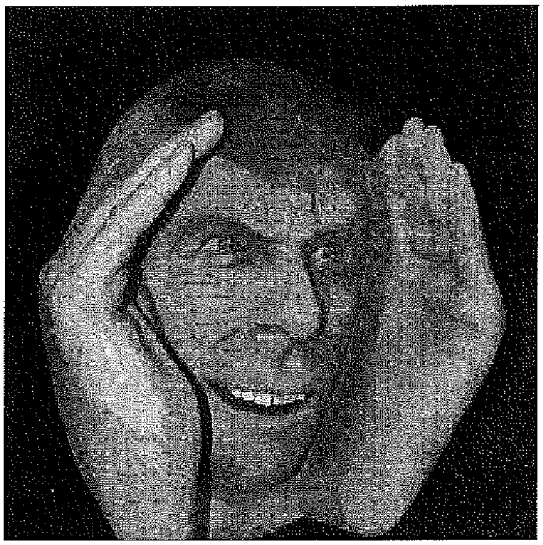
FIG. 6 is a front left perspective view thereof.
Figure 7:
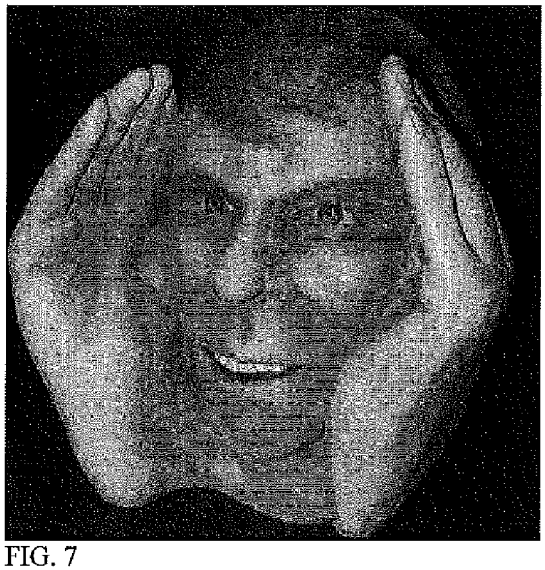
FIG. 7 is a front right perspective view thereof.

I claim: The ornamental design for a mask display system as shown and described in FIGS. 5, 6 and 7.

DETAILED DESCRIPTION OF THE EXAMPLES OF THE INVENTION

Figure 1:
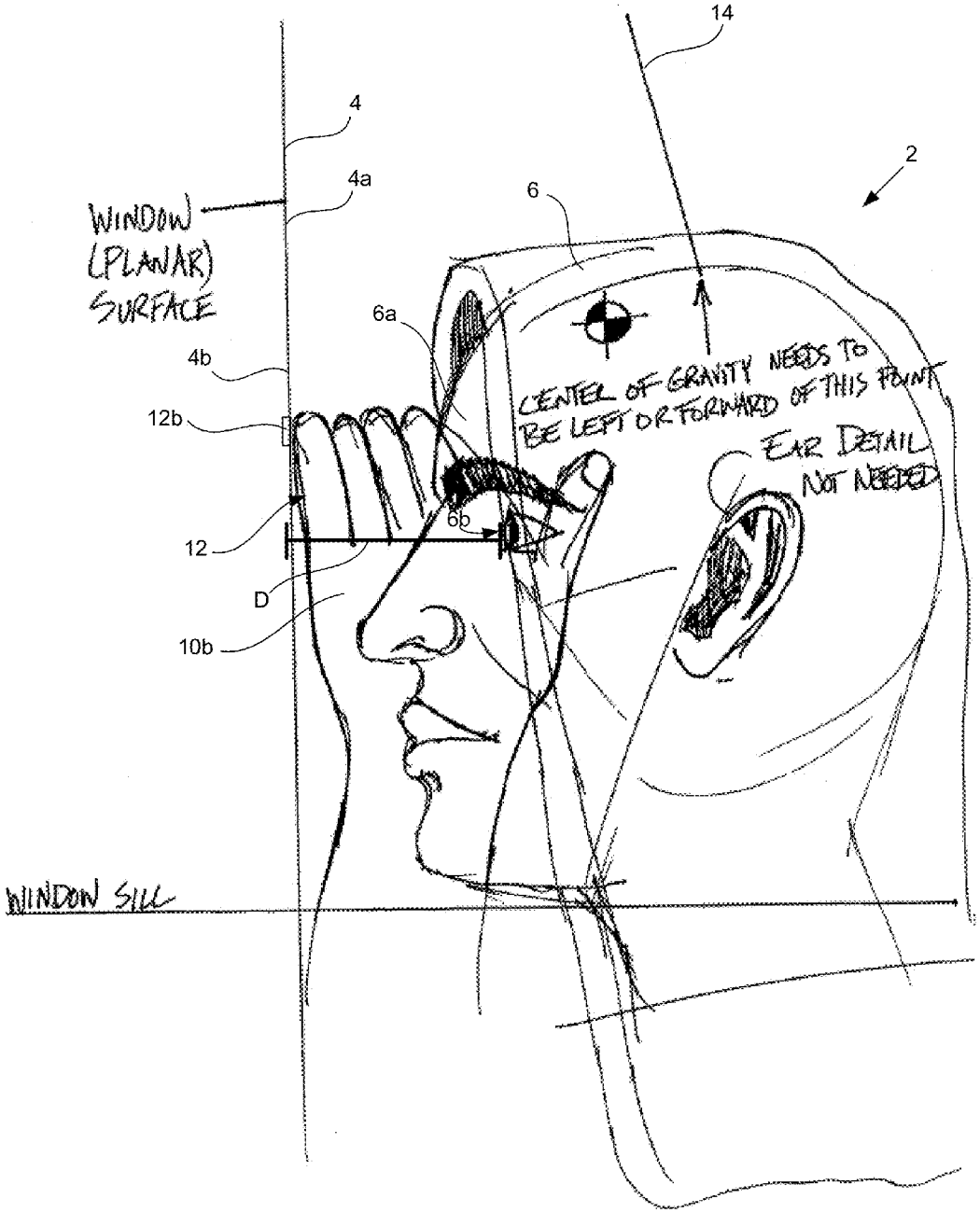
FIG. 1 illustrates a partially transparent side view of one example of a mask display system interfaced with a window.
Figure 2:
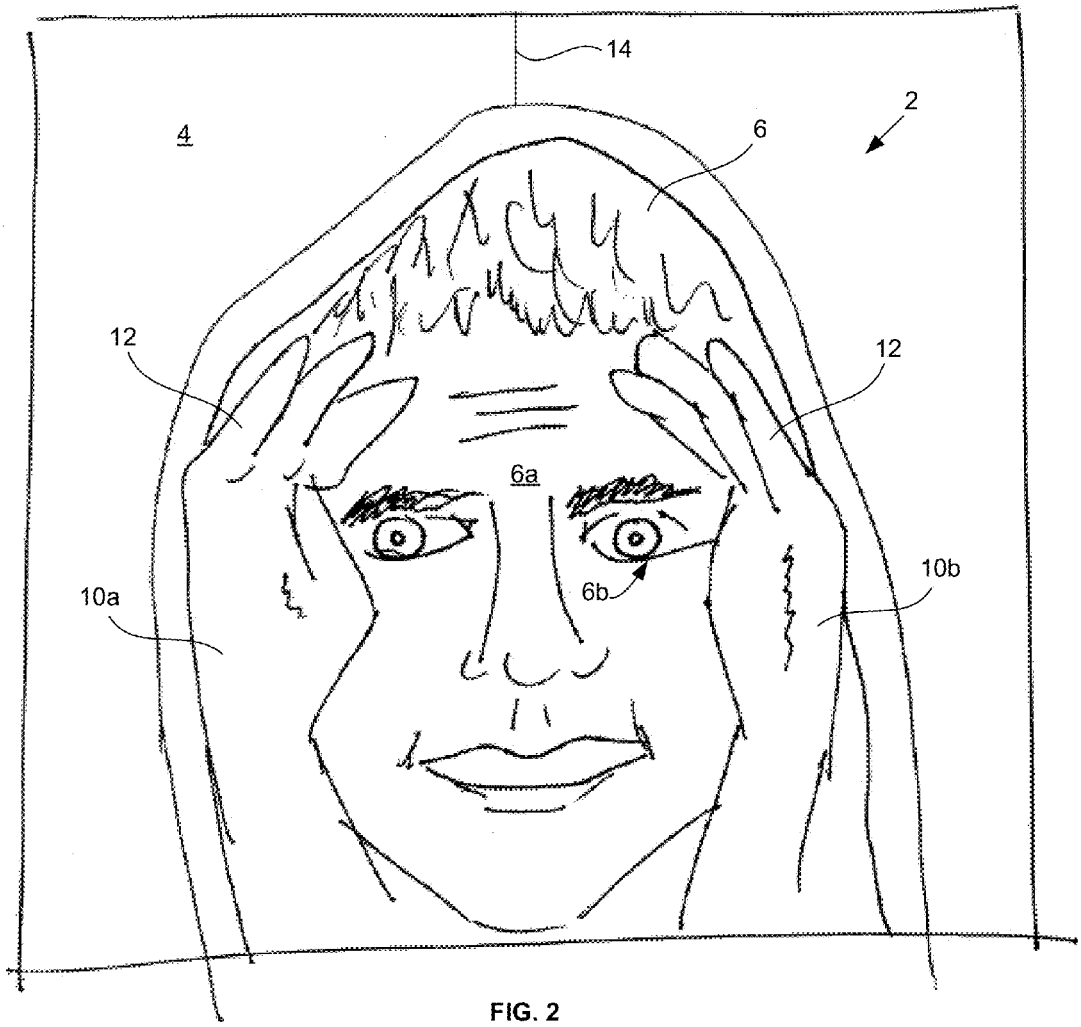
FIG. 2 illustrates a front view of a mask display system interfaced with a window.

FIGS. 1 and 2 illustrate mask display system 2, which represent similar examples of a mask display system as disclosed herein. FIGS. 1 and 2 also illustrate window 4, having an external side 4*a* and an internal side 4*b*. As shown, mask display system 2 is mounted to external window side 4*a*.

Mask display system 2 includes head portion 6 having a face 6*a* including at least one open eye surface 6*b*. Face 6*a* is positioned proximal to the external window side 4*a*. In this example, face 6*a* resembles a human male face, however, faces may vary from example to example. For example, faces may resemble any of the variety of human faces varying by any combination of sex, age, race, etc. Further, faces may resemble animal faces, e.g., bear, monkey, etc. Still, some faces may be fictional, mystical, morbid, etc. Similarly, face dimensions and volumes may vary. In one example, a face may have a length of about 15 to about 30 centimeters. In one example, a face may have a width of about 15 to 25 centimeters. Preferably, the size is about life size, to provide verisimilitude.

Mask display system 2 also includes a pair of hands 10*a* and 10*h* attached to head portion 6. Hand positioning relative to the head portion may vary. In many examples, the palm of one or both hands more hands is positioned proximally to the head portion and the back of each hand is positioned distally to the head portion. Further, one or more of the hands may include a curvature, e.g., and inward curvature as illustrated in FIG. 1. In some examples, one hand may be positioned at the side of the face, and one hand may be positioned above the face. Preferably, the hands are positioned about the face in a pose simulating where people place their hands to shade their eyes from bright lights from the side.

It will be apparent that mask display system will differ significantly from other novelty items, where the hands attach to arms, and arms attach to shoulders of a torso. In contrast, many examples of mask display system disclosed herein, hands will attach directly to the head portion (and indeed in many cases be integrally formed with the head portion). As such, in many examples, mask display system will not include elbows, or shoulders. Hand attachment to the head portion can vary from example to example, e.g., the hands may be attached by at least a portion of each palm, by at least a portion of at least one finger, by at least one finger and at least a portion of a palm, etc. Further, in many examples, the hands may extend distally from the head portion to define a window interface surface 12. As seen in this example, at least one portion of the window interface surface is positioned on one side of the head portion and at least another portion of the window interface surface is positioned on the opposite side of the head portion, which applicant believes will improve stabilization of the mask display system. Other examples include other configurations. The window interface surface may be defined by a variety of different hand portions, for example, at least in part by the small finger of a hand, at least in part by the edge of a palm, at least in part by a palm, etc.

The window interface surface may create a distance D between the at least one open eye surface and the external surface of the window. As used herein, open eye surface includes an eye surface resembling an open eye, e.g., such that an iris is visible, or an eye that has been covered by a surface, e.g., eyewear or glasses. For eyes covered by a surface, the eye itself may or may not be visible. D may vary from one example to the next, for example, D may be chosen from at least one of about 1 to about 8 inches, about 1 to about 6 inches, and about 1 to about 4 inches.

The length of the linear surface of contact of the window interface surface with the window pane may also vary. For example, the window interface surface may have a length chosen from at least one of about 4 inches to about 24 inches, about 6 inches to about 20 inches, and about 8 inches to about 16 inches.

The window interface surface may include a substantially planar portion, e.g., portion 12*b*, thereby allowing the window interface surface to abut the external side of the window pane along the planar portion. In many examples, the window interface surface may also include another portion of the head portion, e.g., a forehead portion, a hat portion, or a hood portion, that extends toward the window.

The mask display system may be made from a variety of materials. For example the system may be made or a suitable polymer, using a variety of methods, such as vacuum forming, thermoforming, injection molding, etc. In some examples, at least a portion of the window interface surface will be chosen to have coefficient of friction (μ) between the glass of the window and the window interface surface of about 0.5 or greater. Desired μ values may be achieved by at least one of material selection and the use of adhesives, e.g., liquid or tape-style adhesives. In some examples, the window interface surface may include a plurality of stacked-taped adhesives, thereby allowing a user to pull off and discard the used tape prior to reuse of the mask display system.

Figure 3:
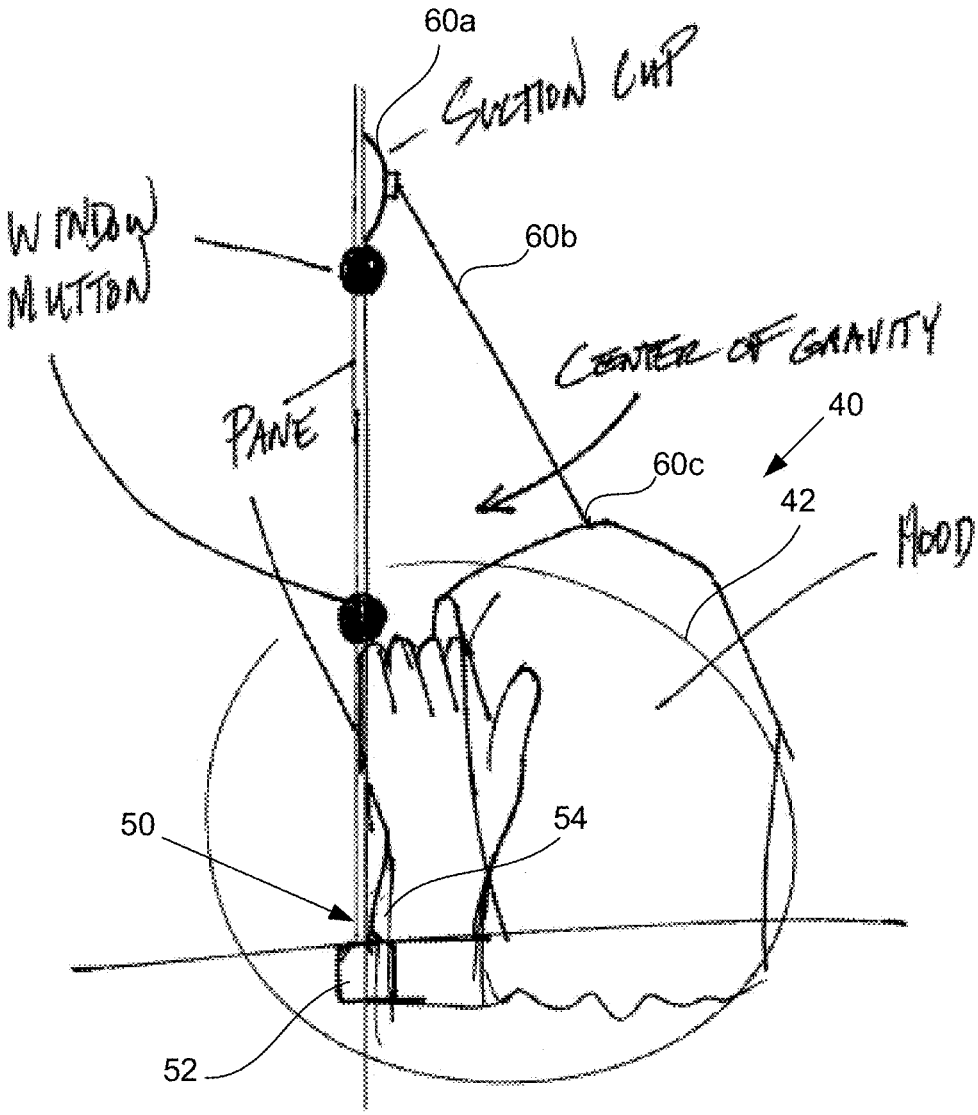
FIG. 3 illustrates a side view of another example of a mask display system.
Figure 4:
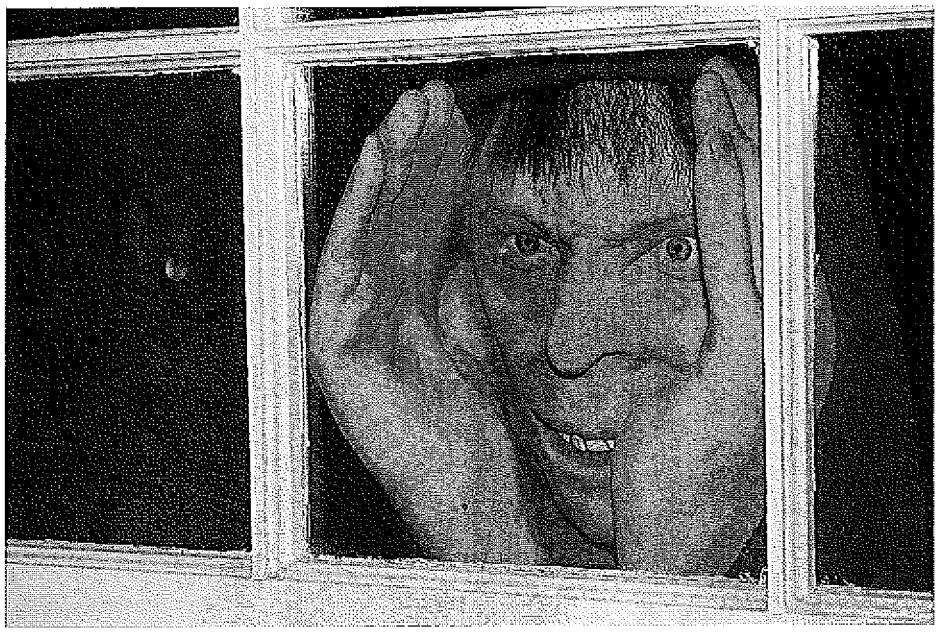
FIG. 4 is a perspective view of the mask display system as mounted on a window, from the view inside the window.

The window interface surface may further include a window sill rest configured to interface with a window sill. FIG. 3 illustrates mask display system 40 having a window sill rest 50 configured to interface with sill 52. In this example, the window sill rest includes a recess defined in the wrist 54, but in other examples, window sill rest may be defined by other parts of the hand and have other structures for interfacing, e.g., a flange, a shelf, a clamp, etc. In addition to increasing stability, window sill rest may also be useful for determining improved positioning of the mask display system relative to the window sill.

FIG. 3 also illustrates a suspension system 60 for suspending the head portion 42. In this example, suspension system 60 includes an upper attachment (e.g., suction cup 60*a*), a hang line 60*b*, and a lower attachment 60*c* attached to the head portion 42.

Lower attachment 60*c* may be attached to the top of head portion 42, as shown, or to some other location. Lower attachment 60*c* will often be placed behind the center of gravity such that the heavier portion of the head portion is proximal to the window. Applicant believes that in many examples, this type of positioning will create a more realistic display of the mask display system, shifting the weight of the head to toward the window, to better mimic a peeping tom action. Additionally, in many examples, the hang line may be translucent, e.g., monofilament, fluorocarbon, etc., to minimize visualization of the hang line by a viewer from the internal side of the window. Opaque hang lines of small diameter and with a strength sufficient to support the head portion may also be suitable. In other examples, the suspension system may be configured in other ways.

For example, the suspension system may include at least one suction cup connected directly to the hands, face, or head covering of the mask display system. In these examples, the suction cups may be selected to have a smaller diameter. Still, in other examples, the suspension system may include an adhesive, e.g., liquid or tape, selected to have a bonding strength sufficient to hold the mask display system in place for at least one of at least 2 minutes, at least 3 minutes, at least 4 minutes, and at least 5 minutes. In many examples, the adhesive will be selected to hold the mask display system in the desired position until its removal by a user, target, etc. In some examples, however, adhesive strength may be selected to allow the mask display system to drop from the window after a predetermined amount of time, thereby mimicking a duck or retreat by a peeping tom simulated by the mask display system. The adhesive may be positioned on any variety of window interface surface locations, and may include liquid or tape style adhesives.

The current disclosure is also directed to methods of using and displaying mask display system. In one example, a user selects a window having an external surface upon which to display the mask display system. A suspension system is attached at one end to a window, and the head portion is positioned slightly above and proximal to the window sill. The pair of hands are positioned against the external surface of the window, such that at least part of the window interface surface interfaces the window. The vertical positioning of the mask display system relative to the window sill may be adjusted as needed, for example, by relocation of the upper attachment, or by adjusting the length of hang line 60*b*. For example, a tag end of hang line 60*b* may be accessible and adjustable through the head portion, thereby allowing relative shortening and lengthening of the effective hang line length. In some examples, a window sill rest may also be interfaced with the sill of the window.

The current disclosure is also directed to sales and display systems for mask display system. In one example, a sales and display system includes a rigid translucent or transparent pane, e.g. of plastic, having a customer-proximal side and a customer-distal side (sales window). The sales window may be framed by a rigid material, e.g., corrugated cardboard or paperboard, to provide the desired rigidity. The transparent or translucent pane of the sales sheet may also include additional indicia to make it resemble a window or a portion of a window, e.g., muntins, sashes, sills, etc.

Any of the mask display system described above may be interfaced with the sales window such that it appears the mask display system is looking through a pane of the sales window. In effect, the sales system recreates for sales purposes the interface of the mask display system with an actual window, and is designed to be positioned such that the mask display system appears to be looking in the direction of the customer. Using sales and display systems described herein, the function of the mask display system is readily apparent, which applicant believes with further contribute to sales.

Numerous characteristics and advantages have been set forth in the foregoing description, together with details of structure and function. The disclosure, however, is illustrative only, and changes may be made in detail, especially in matters of shape, size, and arrangement of parts, within the principle of the invention, to the full extent indicated by the broad general meaning of the terms in which the general claims are expressed.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein, and every number between the end points. For example, a stated range of "1 to 10" should be considered to include any and all sub-ranges between (and inclusive of) the minimum value of 1 and the maximum value of 10; that is, all sub-ranges beginning with a minimum value of 1 or more, e.g. 1 to 6.1, and ending with a maximum value of 10 or less, e.g., 5.5 to 10, as well as all ranges beginning and ending within the end points, e.g. 2 to 9, 3 to 8, 3 to 9, 4 to 7, and finally to each number 1, 2, 3, 4, 5, 6, 7, 8, 9 and 10 contained within the range. It is further noted that, as used in this specification, the singular forms "a," "an," and "the" include plural referents unless expressly and unequivocally limited to one referent.

What is claimed is:

1. A mask display system for mounting on an external side of a window, the mask display system compromising:

a head portion having a face including at least one open eye surface, the face for positioning proximal to the external side of the window;

a pair of hands attached to the head portion, wherein the pair of hands extend distally from the head portion to define a window interface surface; and a suspension system for attaching at one end to the window and at the other end to the head portion.

2. The mask display system of 1, wherein the window interface surface includes a substantially planner portion, thereby allowing the window interface surface to flushly abut the external side of the window.

3. The mask display system of 1, wherein at least one portion of the window interface surface is positioned on one side of the head portion and at least another portion of the window interface surface is positioned on the opposite side of the head portion, thereby stabilizing the mask display system.

4. The mask display system of 3, wherein the window interface surface is defined, at least in part, by the small finger of each hand.

5. The mask display system of 3, wherein the window interface surface is defined, at least in part, by the edge of each palm.

6. The mask display system of 1, wherein the window interface surface has a length chosen from at least one of about 4 inches to about 24 inches, about 6 inches to about 20 inches, and about 8 inches to about 16 inches.

7. The mask display system of 1, wherein the window interface surface further includes a window sill rest.

8. The mask display system of 7, wherein the window sill rest is defined at least in part by the pair of hands.

9. The mask display system of 8, wherein the window sill rest includes at least one of a flange, a shelf, and a clamp.

10. The mask display system of 1, wherein the window interface surface creates a distance D between the at least one open eye surface and the external surface of the window.

11. The mask display system of 10, wherein D is chosen from at least one of about 1 to about 8 inches, about 1 to about 6 inches, and about 1 to about 4 inches.

12. The mask display system of 1, wherein the window-window interface surface coefficient of friction ($\mu$) is about 0.5 or greater.

13. The mask display system of 1, wherein the palm of each hand is positioned proximally to the head portion and the back of each hand is positioned distally to the head portion.

14. The mask display system of 1, wherein each of the pair of hands includes an inward curvature.

15. The mask display system of 1, wherein the hands are attached to the head portion by at least a portion of each palm.

16. The mask display system of 15, wherein the hands are attached to the head portion by at least a portion of a least one finger.

17. The mask display system of 1, wherein the suspension system is attached to the top of the head portion.

18. The mask display system of 1, wherein the suspension system includes a hang line.

19. The mask display system of 18, wherein the hang line is translucent.

20. A mask display system for mounting on an external side of a window, the mask display system comprising:

A head portion having a face including at least one open eye surface, the face for positioning proximal to the external side of the window;

a pair of hands attached to the head portion, wherein the pair of hands extend distally from the head portion to define a substantially planner window interface surface, wherein at least one portion of the window interface surface is positioned on one side of the head portion and at least another portion of the window interface surface is positioned on the opposite side of the head portion, thereby stabilizing the mask display system, wherein the window interface surface has a length chosen from at least one of about 4 inches to about 24 inches, about 6 inches to about 20 inches, and about 8 inches to about 16 inches, wherein the window interface surface creates a distance D between the at least one open eye surface and the external surface of the window, D being chosen from at least one of about 1 to about 8 inches, about 1 to about 6 inches, and about 1 to about 4 inches; and a suspension system for attaching at one end to the window and at the other end to the top of the head portion, the suspension system including a hang line extending between the end connected to the window and the end attached to the top of the head portion.

* * * * *